United States Patent [19]

Nagel et al.

[11] 4,414,864

[45] Nov. 15, 1983

[54] MEANS FOR ACCOMMODATING AN INK ROLLER

[75] Inventors: Gerhard Nagel, Hirschhorn; Klaus Dasting, Neckarsteinach, both of Fed. Rep. of Germany

[73] Assignee: Esselte Pendatflex Corporation, Garden City, N.Y.

[21] Appl. No.: 291,127

[22] Filed: Aug. 7, 1981

[30] Foreign Application Priority Data

Sep. 5, 1980 [DE] Fed. Rep. of Germany ..... 3033572

[51] Int. Cl.[3] ..... B25B 9/00

[52] U.S. Cl. ..... 81/3 R

[58] Field of Search ..... 81/3 R; 29/24 R, 270, 29/278; 206/318, 389, 402; 211/126; 248/49, 50; 294/5.5, 137; 269/296

[56] References Cited

U.S. PATENT DOCUMENTS

| | | | |
|---|---|---|---|
| 1,789,546 | 1/1931 | Gunnell | 206/318 |
| 2,491,860 | 12/1949 | Ingraham | 81/3 R |
| 2,895,729 | 7/1959 | Sanders | 269/296 |
| 3,030,701 | 4/1962 | Regennitter | 29/270 |
| 3,741,403 | 6/1973 | Fleischer, Jr. et al. | 211/126 X |
| 3,828,726 | 8/1974 | Dietze et al. | 269/296 X |

*Primary Examiner*—James G. Smith

*Attorney, Agent, or Firm*—Gerald J. Ferguson, Jr.; Joseph J. Baker

[57] ABSTRACT

A device for mounting an ink roller made up of a cylindrical ink carrier body and having on its ends, end-disks. The diameter of these end-disks is larger than the ink roller body. Such ink rollers are used in printing devices in order that the printing type characters are inked prior to the actual printing process. To simplify the handling of such ink rollers, especially when exchanging a used ink roller for a new ink roller while at the same time avoiding the smudging of fingers or clothing of service personnel, the device is provided with two U-shaped cups that are interconnected and whose widths—at the open ends—are equal to the width of the new ink roller. The depth of these cups is equal to the diameter of the end disks of the new ink roller, and the cups are provided on both their sides with areas which act as clamps for the end disks and whereby the width of one cup—in its entire dept—is constant; while the width of the other cup increases from the open end in the width of the other cup increases from the open end in the direction of the closed-off end.

3 Claims, 4 Drawing Figures

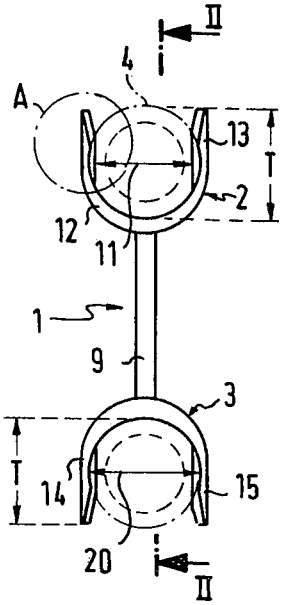
FIG. 1
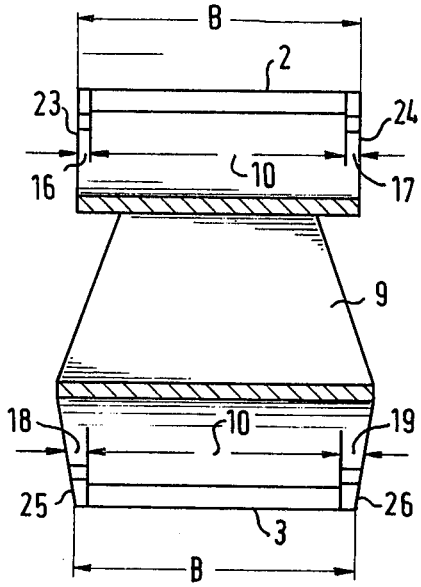
FIG. 2
FIG. 3
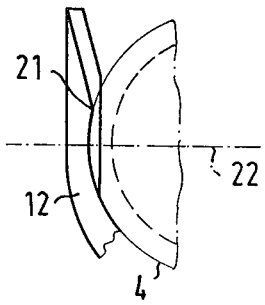
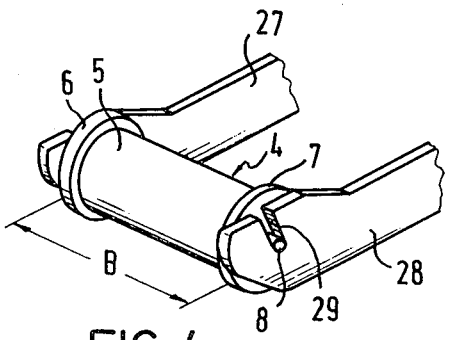
FIG. 4

MEANS FOR ACCOMMODATING AN INK ROLLER

BACKGROUND AND SUMMARY OF THE INVENTION

The present invention relates to a means for accommodating an ink roller which comprises a circular cylindrical ink carrier body and end discs which are disposed at the end faces thereof and the diameter of which is greater than that of the ink carrier body.

Ink rollers are employed in printing apparatuses for inking the print types prior to carrying out the actual printing operation. For example, DE-OS No. 2,502,108 describes the use of an ink roller in a hand labelling apparatus where it inks the print types of a printing mechanism accommodated in the apparatus before a pressure sensitive label is provided with an imprint. Such ink rollers may also be used in stamps which operate with automatic type inking.

The ink with which the ink roller is impregnated can hardly be removed from a surface on which it has been imprinted. This naturally very desirable property of the ink requires particular precautions when handling the ink roller and in particular when replacing a used ink roller by a new roller in order to avoid soiling the fingers or clothing of the operator.

The object of the invention is to provide an apparatus which permits clean storage and manipulation of new and used ink rollers.

According to the present invention this object is achieved in that U-shaped shells connected together are provided whose width at their open ends is equal to the width of the ink roller to be accommodated, whose depth is equal to the diameter of the end discs of the ink roller to be accommodated, said shells having at their two sides regions which act as clamps for the end discs, the width of the one shell being constant over its entire depth and the width of the other shell increasing from the open end in the direction towards the closed end. The means according to the invention make it possible to remove a used ink roller from the printing mechanism without having to touch the ink roller with the fingers. Thereafter, the new ink roller held by the means can be inserted into the printing mechanism and this is also done without any direct contact with the ink roller. The used ink roller remains in a relatively protected position in the means according to the invention, substantially reducing the risk of unintentional contact therewith.

Other objects, advantages, and novel features of the present invention will become apparent from the following detailed description of the invention and considered in conjunction with the accompanying drawings.

BRIEF DESCRIPTION OF THE DRAWINGS

FIG. 1 is a side view of the means according to the invention.

FIG. 2 is a section along the line II—II of FIG. 1.

FIG. 3 is a detailed view of the fragment A of FIG. 1 and

FIG. 4 is a perspective view of a holder disposed in a printing mechanism into which an ink roll can be inserted using the means according to the invention.

DETAILED DESCRIPTION OF THE INVENTION

The ink roller accommodating means 1 illustrated in side view in FIG. 1 and in section in FIG. 2 includes two U-shaped shells 2 and 3 which can each receive an ink roller 4 shown in dashed line in FIG. 1. The ink roller 4 clearly shown in FIG. 4 includes an ink carrier body 5 and end discs 6 and 7 at the end faces thereof. The width of the ink roller 4 measured at the outer surfaces of the end discs is indicated by B; its depth is designated by T. At the end discs 6 and 7 two journals 8 project, one of which can be seen in FIG. 4.

According to FIG. 1 two shells 2 and 3 are connected together by a web 9 whose width decreases towards the shell 10 for a reason to be explained hereinafter.

The inner surfaces of the shells 2 and 3 are so formed that in each main portion 10 of each shell the internal spacing 11 between the legs 12, 13 and 14, 15 is greater than the diameter of the ink carrier body 4 but smaller than the diameter of the end discs 6 and 7. The width of the main portion corresponds to the width of the ink carrier body 5.

Adjoining on each side of the main portion 10 of each shell 2, 3 are narrow regions 16, 17 and 18, 19 in which the inner spacing 20 corresponds to the diameter of the end discs 6, 7 and which act as shells for the end discs 6, 7 as will be explained hereinafter. The fragmental view of FIG. 3 shows that the inner surface of the legs 12 to 15 is made arcuate in the regions 16 to 19 for adaptation to the outer surface of the end discs 6 and 7. The arcuate form ends at a point 21 which lies above the centre plane 22 of the ink roller 4 indicated in the dot-dashed line in FIG. 3. From the point 21 onwards the spacing of the legs 12, 13 and 14, 15 widens in the regions 16, 17 and 18, 19 respectively in funnel-like manner towards the open end of the shells 2 and 3.

The reason for the inner spacing 20 between the legs 12 to 15 of the shells 2, 3 corresponding to the diameter of the end discs 6, 7 of the ink roller 4 only in the regions 16 to 19 whilst the inner spacing 11 in the portion 10 of each shell 2, 3 is less than said diameter is that in this manner the ink roller 4 is held in the shells 2, 3 non-displaceably in the axial direction and can only be inserted into the shells 2, 3 in an exactly defined position in which the end discs 6, 7 lie in the regions 16, 17 or 18, 19.

In the shell 2 the outer surfaces 23 and 24 run parallel to each other at a spacing corresponding to the width B of the ink roller 4. However, the outer surfaces 25 and 26 of the shell 3 become larger from the open end with the width B to the closed end of the U-shape.

The ink roller accommodation means 1 initially contains in the shell 2 a new unused ink roller 4 which is to be inserted to replace a used ink roller in a printing mechanism. The ink roller 4 is held in the shell 2 at its end discs 6, 7. The clamping action is due, as already mentioned, to the inner surfaces of the legs 12 and 13 extending arcuately in the regions 16 and 17 up to a point 21 which lies above the centre plane 22 of the inserted ink roller 4. The insertion of the ink roller 4 into the shell 2 thus takes place after a slight spreading apart of the legs 12 and 13 with a snap action.

Now, when a used ink roller 4 which according to FIG. 4 is mounted in a holder of a printing mechanism comprising two arms 27 and 28 is to be replaced by the ink roller 4 disposed in the accommodation means 1, the used ink roller 4 must first be removed from the holder.

For this purpose the shell 3 of the accommodation means 1 is placed in FIG. 4 from above on the ink roller 4 in the holder. Since the spacing of the outer surfaces 25 and 26 of the shell 3 at the open end of the U-form correspond to the width B of the ink roller 4, the outer surfaces 25 and 26 at said open end come into engagement with the inner surfaces of the arms 27 and 28. If the accommodating means 1 is now pushed further against the ink roller 4 the inclined outer surfaces 25 and 26 cause the arms 27 and 28 to be spread apart; the shell 3 finally snaps by means of the regions 18 and 19 on the end discs 6, 7 of the ink roller 4 so that said roller is held firmly by the shell 3 and can be removed from the holder because the journals 8 are no longer in engagement with the slot 29.

The accommodating means 1 is now turned and the shell 2 with the ink roller disposed therein is introduced between the arms 27 and 28 so that the journals 8 come to bear in corresponding slots 29 in the arms 27 and 28. Since the outer surfaces 23 and 24 of the shell 2 extend parallel to each other with the spacing corresponding to the width of the ink roller 4, when the new ink roller is inserted the arms 27 and 28 are not spread apart so that the short journals 8 do in fact come into engagement with the slots 29. To enable the accommodating means 1 to be detached from the ink roller 4 said means 1 must be turned somewhat about the axis of the ink roller 4 so that the accommodating means can then be withdrawn from the ink roller in a direction deviating from the direction of the slots 29. It would also be possible to provide the slots 29 with a small constriction so that they accommodate the journals 8 with snap action and resist an only slight withdrawing force. In this case the accommodating means 1 could be withdrawn from the ink roller in the same direction in which the introduction of the journals 8 into the slots 29 was made.

It is apparent from the use outlined of the ink roller accommodating means 1 that at a certain instant, i.e. after removal of the used ink roller, there is an ink roller both in the shell 2 and in the shell 3. It would be possible to erroneously insert into the holder with the arms 27 and 28 the ink roller 4 which has just been removed and is disposed in the shell 3 instead of the new ink roller 4 disposed in the shell 2. To make this impossible the outer surfaces 25 and 26 of the shell 3 are so formed that on introduction of the shell 3 between the arms 27 and 28 they spread the latter apart. Because of this spreading apart the journals 8 do not come into engagement with the slots 29 so that it is not possible for the ink roller 4 disposed in the shell 3 to be inserted into the holder of the printing mechanism. Only the new ink roller 4 disposed in the shell 2 can be inserted because when using the shell 2 the arms 27 and 28 are not spread apart and consequently the journals 8 can come into engagement with the slots 29.

Since it is not always easy to distinguish between the used ink roller and the new ink roller the web 9 of the accommodating means 1 is made in the manner already described so that its width diminishes from the shell 3 to the shell 2. This form of the web 9 permits an optical clear distinction between the two ink rollers 4 held thereby in a phase of the replacement operation. The purpose of the internal spacing 11 of the inner surfaces of the legs 12 and 13 being greater than the diameter of the ink carrier body 5 of the ink roller 4 is to avoid contacting of the upper surface of the ink carrier body 5 by the shell 2. Such a contacting is undesireable because a constant pressure would thereby be exerted on the ink carrier body 5 which would lead to expulsion of ink at the point of contact and thus to an irregular ink distribution in the ink carrier body 5.

Thus, using the ink roller accommodating means 1 described it is possible to replace a used ink roller in a printing mechanism by a new ink roller without having to touch the ink rollers directly with the fingers.

What is claimed is:

1. An apparatus for accommodating an ink roller having a circular cylindrical ink carrier body and end discs which are disposed at the end faces thereof and the diameter of which is greater than that of the ink carrier body, said apparatus comprising two U-shaped shells connected together whose width at their open ends is equal to the width of the ink roller to be accommodated, whose depth is equal to the diameter of the end discs of the ink roller to be accommodated, said shells having at their two sides regions which act as clamps for the end discs, the width of the one shell being constant over its entire depth and the width of the other shell increasing from the open end in the direction towards the closed end wherein the shells are joined together in such a manner that their open ends point in opposite directions.

2. A means as claimed in claim 1 wherein the inside spacing of the inner surfaces of the legs of the shells in a main portion of the width of the ink carrier body is smaller than the diameter of the end discs but greater than the diameter of the ink carrier body of the ink roller to be accommodated and the regions acting as clamps for the end discs adjoin on both sides of the main portion and have an inner spacing which is equal to the diameter of the end discs.

3. A means as claimed in claim 1 wherein the shells are connected by means of a web whose width diminishes in the direction towards the shell whose width is constant.

* * * * *

UNITED STATES PATENT AND TRADEMARK OFFICE

CERTIFICATE OF CORRECTION

PATENT NO. : 4,414,864

DATED : November 15, 1983

INVENTOR(S) : Gerhard Nagel, et al.

It is certified that error appears in the above-identified patent and that said Letters Patent are hereby corrected as shown below:

On the title page, the assignee should read:

-- Esselte Pendaflex Corporation--.

Signed and Sealed this

*Twentieth* Day of *March 1984*

[SEAL]

*Attest:*

GERALD J. MOSSINGHOFF

*Attesting Officer*

*Commissioner of Patents and Trademarks*